US007308749B2

(12) United States Patent
Okada et al.

(10) Patent No.: US 7,308,749 B2
(45) Date of Patent: Dec. 18, 2007

(54) PRODUCTION METHOD FOR DIELECTRIC RESONATOR DEVICE

(75) Inventors: Takahiro Okada, Kanazawa (JP); Jinsei Ishihara, Omihachiman (JP); Hideyuki Kato, Ishikawa-ken (JP); Hitoshi Tada, Moriyama (JP)

(73) Assignee: Murata Manufacturing Co., Ltd, Kyoto-Fu (JP)

( * ) Notice: Subject to any disclaimer, the term of this patent is extended or adjusted under 35 U.S.C. 154(b) by 214 days.

(21) Appl. No.: 10/238,446

(22) Filed: Sep. 9, 2002

(65) Prior Publication Data

US 2003/0046806 A1 Mar. 13, 2003

(30) Foreign Application Priority Data

Sep. 10, 2001 (JP) ..... 2001-273916

(51) Int. Cl.
*H04R 31/00* (2006.01)

(52) U.S. Cl. ..... 29/594; 29/25.42; 29/592.1; 29/847; 29/852; 125/15; 333/202; 333/206; 333/222; 451/547

(58) Field of Classification Search ..... 29/25.42, 29/592.1, 594, 847, 852; 451/547; 125/15; 333/202, 206, 134, 222
See application file for complete search history.

(56) References Cited

U.S. PATENT DOCUMENTS 4,523,162 A 6/1985 Johnson
5,124,676 A * 6/1992 Ueno ..... 333/206
5,642,084 A * 6/1997 Matsumoto et al. ..... 333/202
5,949,308 A * 9/1999 Hino ..... 333/202
6,020,800 A * 2/2000 Arakawa et al. ..... 333/208
6,177,852 B1 * 1/2001 Tada et al. ..... 333/202
6,595,844 B1 * 7/2003 Mizuno et al. ..... 451/540

FOREIGN PATENT DOCUMENTS

JP 56095573 A * 8/1981
JP 63066704 A * 3/1988
JP 04065206 A * 3/1992
JP 05145313 A * 6/1993
JP 5-183309 A 7/1993
JP 09136248 A * 5/1997

OTHER PUBLICATIONS

"Characteristics of optically controlled dielectric resonators with light injection hole"; Rong, A.S.; Sun, Z.L.; Antennas and Propagation Society International Symposium; Jun. 28-Jul. 2, 1993; pp. 1512-1515.*
Japanese Examination Report issued Jun. 8, 2004 (w/ English translation of relevant portions).

* cited by examiner

*Primary Examiner*—Paul D. Kim
(74) *Attorney, Agent, or Firm*—Dickstein, Shapiro, LLP.

(57) ABSTRACT

A method of forming a dielectric resonator from an inner-conductor-formed hole that has a substantially rectangular or substantially elliptical cross section in a direction perpendicular to the depth direction thereof, by placing a rotary cutting disk in contact with the edge of the opening of the inner-conductor-formed hole, and removing portions of an outer conductor and the inner conductor in the contact portion with the rotary cutting disk, thereby separating the inner conductor and the outer conductor.

7 Claims, 7 Drawing Sheets

PRODUCTION METHOD FOR DIELECTRIC RESONATOR DEVICE

BACKGROUND OF THE INVENTION

1. Field of the Invention

The present invention relates to a production method for a dielectric resonator device, such as a dielectric filter and a dielectric duplexer, in which a resonator is formed in a dielectric block.

2. Description of the Related Art

Dielectric resonator devices in which a dielectric block shaped like a substantially rectangular parallelepiped includes inner-conductor-formed holes each having an inner conductor formed on its inner surface, and an outer conductor formed on the outer surface thereof have been used hitherto as dielectric filters or dielectric duplexers.

U.S. Pat. No. 4,523,162 discloses a method for cutting the edges of an opening of each inner-conductor-formed hole with a sharp-tipped drill, which is placed in the axial direction of the inner-conductor-formed hole so that its end is in contact with the opening, in order that the periphery of the opening of the inner-conductor-formed hole serves as an open end of a resonator in such a dielectric resonator device using a dielectric block.

In the dielectric resonator device disclosed in the above U.S. patent, the inner-conductor-formed holes formed in the dielectric block are through holes of circular cross-section. However, the cross-sectional shape of the inner-conductor-formed holes is not limited to a circle. The cross section of the inner-conductor-formed holes formed in the dielectric block are sometimes substantially rectangular or substantially elliptical in order to reduce the width in the direction in which the inner-conductor-formed holes are arrayed so that multiple inner-conductor-formed holes can be arranged in a small dielectric block, or in order to increase the degree of flexibility in designing the degree of coupling between the resonators of the adjacent inner-conductor-formed holes. It is, however, difficult to apply the above production method to a dielectric resonator device that includes inner-conductor-formed holes having such a cross-sectional shape.

FIG. 10A shows openings of inner-conductor-formed holes. A cut portion 6 is formed by cutting an opening of an inner-conductor-formed hole 2*a* with a drill so as to separate an outer conductor 4 and an inner conductor formed on the inner surface of the inner-conductor-formed hole 2*a*. However, in a case in which the cutting operation is performed using a drill having a diameter larger than the cross-sectional length of the inner-conductor-formed hole 2*a*, when the next inner-conductor-formed hole 2*b* is similarly subjected to cutting, the cut portions 6 around the inner-conductor-formed holes 2*a* and 2*b* are sometimes connected. Furthermore, the cut portion 6 is sometimes substantially enlarged and reaches the next inner-conductor-formed hole 2*b*. In such circumstances, it is impossible to achieve a desired electrical characteristic.

In order that a cut portion will not be enlarged towards the periphery of the next inner-conductor-formed hole, a smaller-diameter drill may be moved along the edge of the opening of the inner-conductor-formed hole 2, as shown in FIG. 10B. In this method, however, a cutting machine to be used must execute control so that the drill moves in a horizontal plane while rotating. Moreover, the cutting time is prolonged, a heavy load is imposed on the drill, and the lifetime of the drill is shortened.

SUMMARY OF THE INVENTION

Accordingly, it is an object of the present invention to provide a production method for a dielectric resonator device having inner-conductor-formed holes of substantially rectangular or substantially circular cross section, which method prevents an opening of each of the inner-conductor-formed holes from being unnecessarily enlarged, shortens the cutting time, and prolongs the lifetime of a cutting tool.

In accordance with the present invention, in order to produce a dielectric resonator device that includes a dielectric block, an inner-conductor-formed hole formed in the dielectric block, an inner-conductor-formed on an inner surface of the inner-conductor-formed hole, and an outer conductor formed on an outer surface of the dielectric block, the cross section of the inner-conductor-formed hole in a direction perpendicular to the depth direction thereof is made substantially rectangular or substantially elliptical, and the inner conductor and the outer conductor are separated at an opening of the inner-conductor-formed hole by removing portions of the outer conductor and the inner conductor that are in contact with a rotary cutting disk placed at the edge of the opening of the inner-conductor-formed hole.

By thus bringing the rotary cutting disk into contact with the edge of the opening of the inner-conductor-formed hole, the cut portion around the opening can be prevented from being excessively enlarged, and cutting can be easily performed only by moving the rotary cutting disk in the depth direction of the inner-conductor-formed hole. In addition, the cutting time can be shortened, and the lifetime of a cutting tool can be prolonged.

Preferably, a plurality of inner-conductor-formed holes are formed so that the directions of the cross-sectional lengths thereof are parallel to one another, and the removal is performed using a plurality of rotary cutting disks aligned with openings of the inner-conductor-formed holes. This makes it possible to substantially enhance the production efficiency of a dielectric resonator device having a plurality of inner-conductor-formed holes formed in a single dielectric block, and to prevent electrical characteristics from varying.

Further objects, features, and advantages of the present invention will become apparent from the following description of the preferred embodiments with reference to the attached drawings.

DESCRIPTION OF THE PREFERRED EMBODIMENTS

A production method for a dielectric filter according to a first aspect of the present invention will be described below with reference to FIGS. 1 to 6.

Figure 1A:
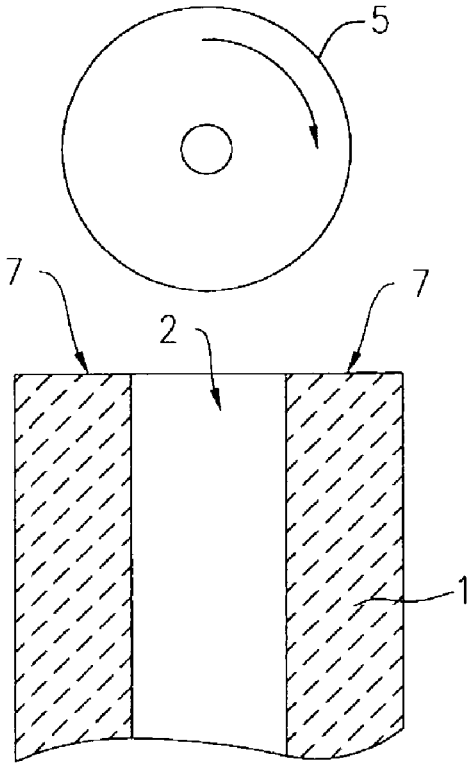
FIGS. 1A and 1B are partial cross-sectional views showing a state immediately before a cutting process in a method for producing a dielectric filter according to a first aspect of the present invention.
Figure 1B:
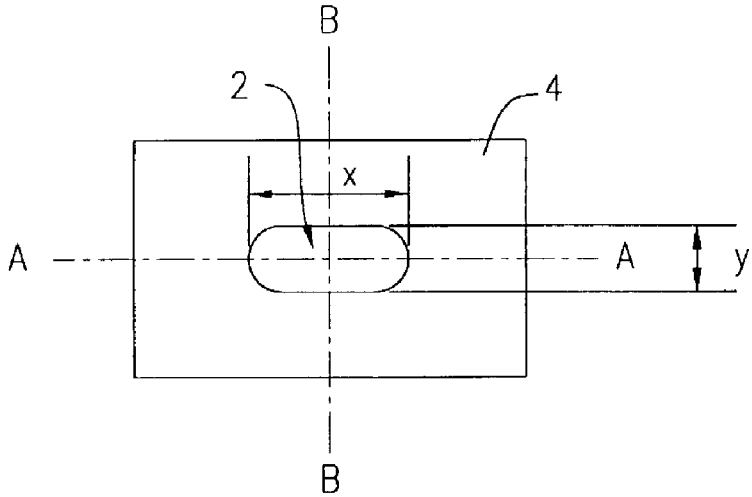

FIGS. 1A and 1B show a state of the dielectric filter before cutting. FIG. 1A is a sectional view, taken along a plane extending in the axial direction of an inner-conductor-formed hole, and FIG. 1B is a plan view of a dielectric block, as viewed from the axial direction (direction of the depth) of the inner-conductor-formed hole. Referring to FIGS. 1A and 1B, the dielectric block 1 has an inner-conductor-formed hole 2. In FIG. 1B, the direction A-A refers to the direction of cross-sectional length of the inner-conductor-formed hole 2, the direction B-B refers to the direction of the cross-sectional width thereof, "x" represents the cross-sectional length of the inner-conductor-formed hole, and "y" represents the cross-sectional width thereof.

A rotary cutting disk 5 is, for example, formed of a disk that is made of synthetic resin or metal, and is set with diamond grains. The diameter of the rotary cutting disk 5 is longer than the cross-sectional length "x" of the inner-conductor-formed hole 2, and the thickness thereof is larger than the cross-sectional width "y".

Figure 2A:
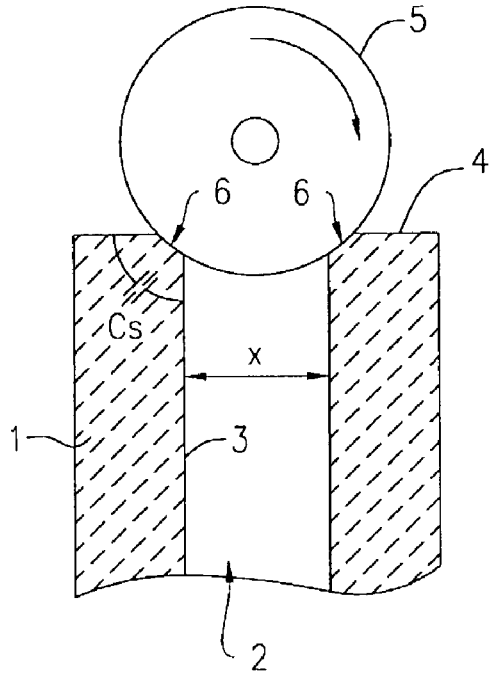
FIGS. 2A and 2B are partial cross-sectional views showing a state during the cutting process.
Figure 2B:
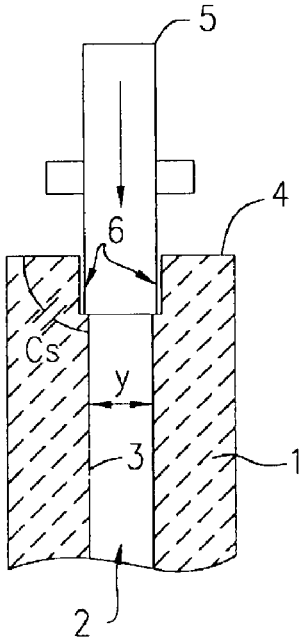

FIGS. 2A and 2B show a state of cutting using the above rotary cutting disk 5. FIG. 2A is a sectional view taken in the direction of cross-sectional length, and FIG. 2B is a sectional view taken in the direction of cross-sectional width. The rotary cutting disk 5 is moved relative to the dielectric block 1 in the depth direction of the inner-conductor-formed hole 2, as shown in FIGS. 2A and 2B. Consequently, the rotary cutting disk 5 abuts an edge of an opening of the inner-conductor-formed hole 2, and partially cuts an inner conductor 3 and an outer conductor 4 together with a dielectric portion of the dielectric block 1.

Figure 3:
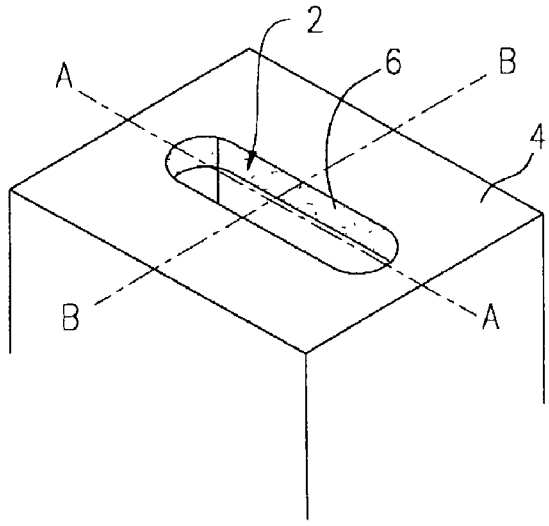
FIG. 3 is a partial perspective view of an opening of an inner-conductor-formed hole in the dielectric filter.

FIG. 3 is a perspective view showing a state of the opening of the inner-conductor-formed hole 2 after the above cutting process. In this way, the edge of the opening of the inner-conductor-formed hole 2 is removed, and a cut portion 6 is formed. The cut portion 6 separates the inner conductor 3 and the outer conductor 4.

Figure 4:
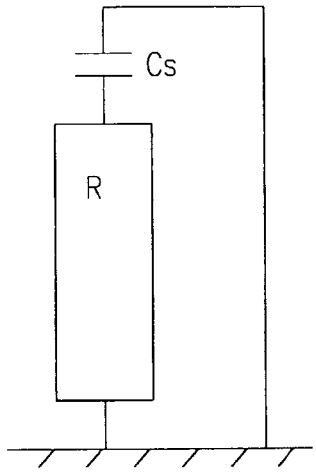
FIG. 4 is an equivalent circuit diagram of the dielectric filter.

FIG. 4 is an equivalent circuit diagram of a resonator formed at the inner-conductor-formed hole 2. In FIG. 4, "R" represents a resonator constituted by the inner conductor 3, the outer conductor 4, and a dielectric therebetween in the dielectric block 1, and "Cs" represents a stray capacitor produced in the cut portion 6 between the periphery of the open end of the inner conductor 3 and the outer conductor 4. In this way, it is possible to produce a quarter-wavelength resonator having the stray capacitor at the open end.

Since the cutting process is performed only by moving the rotary cutting disk 5 straight in the depth direction of the inner-conductor-formed hole 2, the diameter of the rotary cutting disk 5 is larger than the cross-sectional length "x" of the inner-conductor-formed hole 2. By controlling the relative size relationship between the cross-sectional length "x" of the inner-conductor-formed hole 2 and the diameter of the rotary cutting disk 5, the size of the cut portion 6 formed at the opening of the inner-conductor-formed hole 2 can be determined.

Figure 5A:
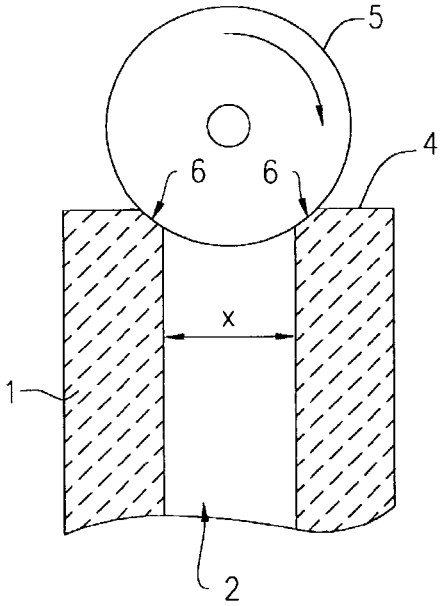
FIGS. 5A and 5B are partial cross-sectional views showing the relationships between inner-conductor-formed holes of different sizes, and a rotary cutting disk.
Figure 5B:
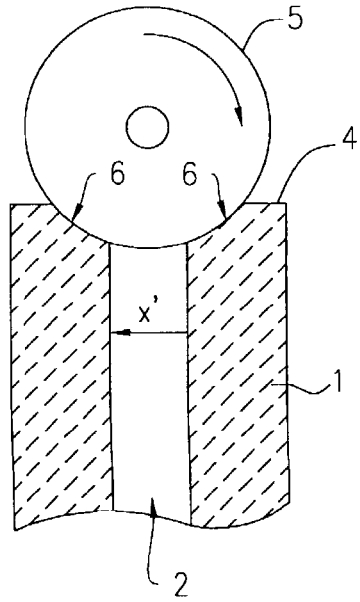

FIGS. 5A and 5B show examples in which rotary cutting disks of the same size are applied to two dielectric resonator devices that are different in the cross-sectional length "x" of the inner-conductor-formed hole. In these examples, when a rotary cutting disk 5 is moved down by a fixed length after it is brought into contact with the dielectric block 1, a cut portion 6 shown in FIG. 5B is larger than in FIG. 5A.

Based on this relationship, the size of the cut portion 6 formed at the opening of the inner-conductor-formed hole 2 may be determined by the moving distance of the rotary cutting disk 5 after its contact with the opening of the inner-conductor-formed hole 2, and the size of the rotary cutting disk 5.

The above also applies to the cross-sectional width of the inner-conductor hole 2. That is, the thickness of the rotary cutting disk 5 is larger than the cross-sectional width "y" of the inner-conductor-formed hole 2. By determining the relative size relationship between the width "y" and the thickness of the rotary cutting disk 5, and the moving distance of the rotary cutting disk 5 after it contact the opening of the inner-conductor-formed hole 2, the size of the cut portion 6 in the widthwise direction of the inner-conductor-formed hole 2 can be determined.

Figure 6C:
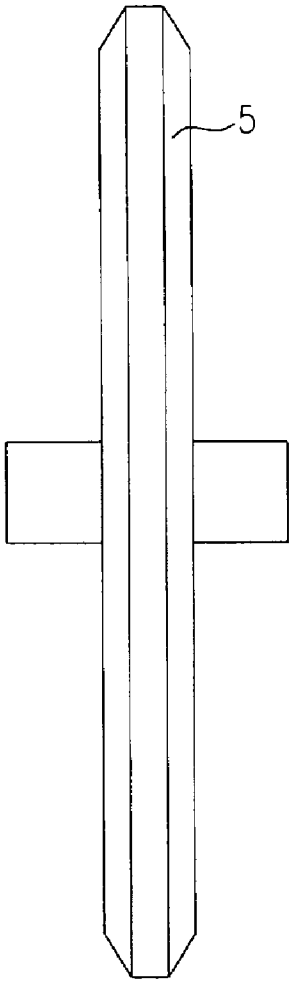
FIGS. 6A to 6C are plan views showing the shapes of other rotary cutting disks.
Figure 6B:
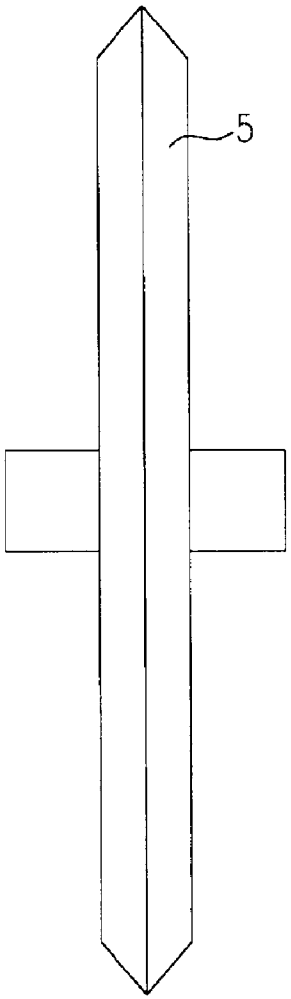
Figure 6A:
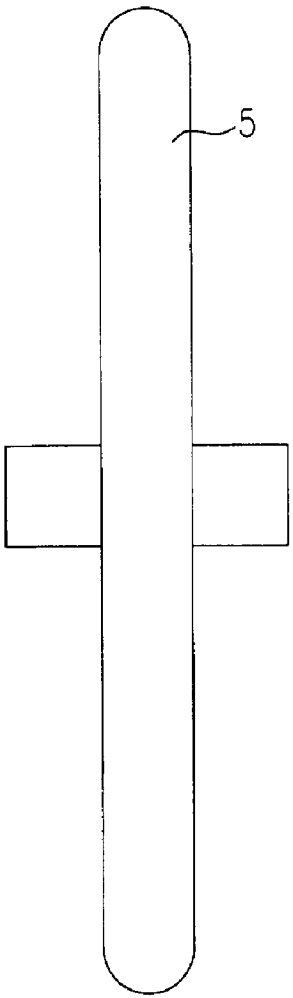

FIGS. 6A to 6C are side views showing examples of shapes of the rotary cutting disk 5. The cross section of the peripheral portion of the rotary cutting disk 5 is round in FIG. 6A, has a sharp edge in FIG. 6B, and is trapezoidal in FIG. 6C. Since the thickness decreases toward the periphery, the rotary cutting disk 5 can be smoothly inserted from the opening into the inner-conductor-formed hole 2. Moreover, since a cut portion slightly extends at the beginning of the contact of the rotary cutting disk 5 with the opening of the inner-conductor-formed hole 2, a minute cut portion can be formed easily.

A production method for a dielectric duplexer according to a second aspect of the present invention will now be described with reference to FIGS. 7 to 9.

Figure 9:
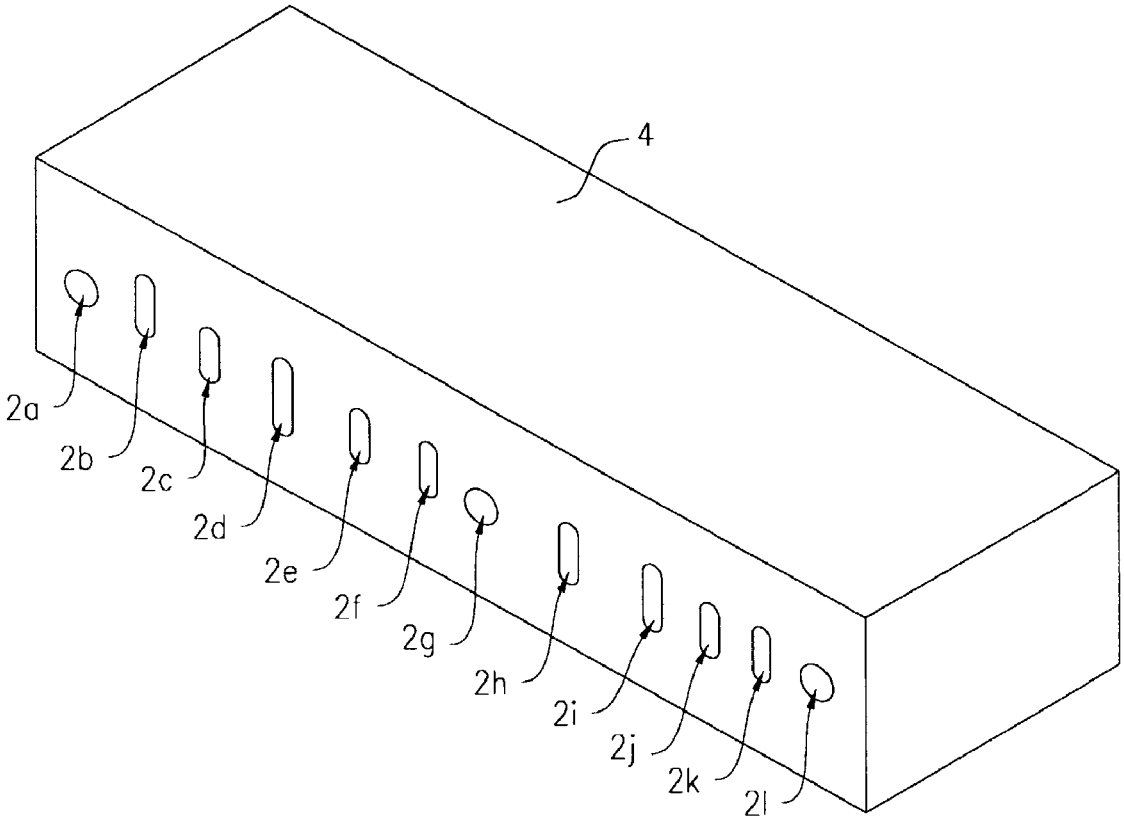
FIG. 9 is a perspective view of a dielectric duplexer.
Figure 10A:
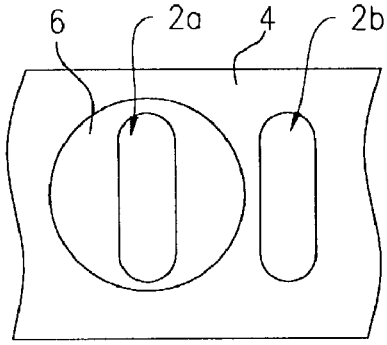
FIGS. 10A and 10B are views showing a related production method for a dielectric resonator device.
Figure 10B:
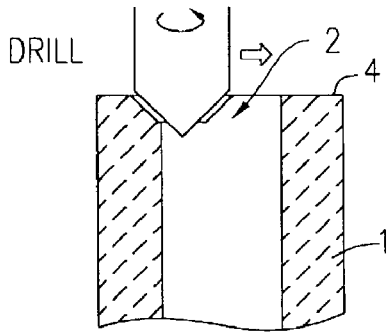

FIG. 9 is a perspective view of a dielectric duplexer. A plurality of inner-conductor-formed holes 2*a* to 2*l* are opened from one surface to the opposite surface of a dielectric block that is shaped like a substantially rectangular parallelepiped. An outer conductor 4 is formed on the outer surface of the dielectric block.

Figure 8A:
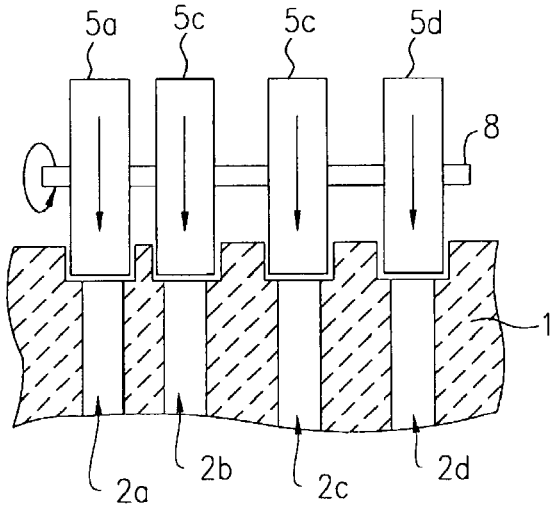
FIGS. 8A to 8C are partial cross-sectional views showing a cutting process in a production method for the dielectric duplexer.
Figure 8B:
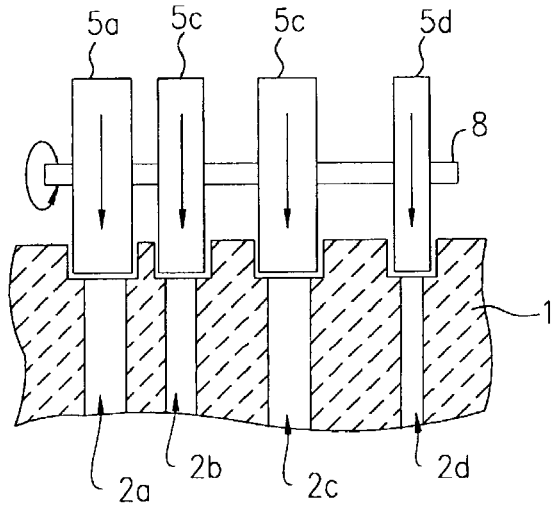
Figure 8C:
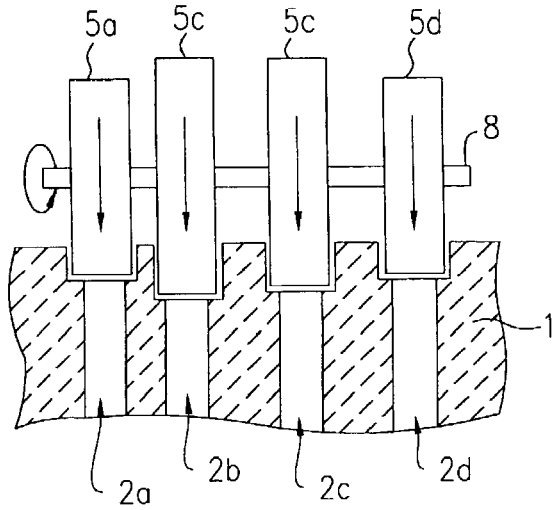

FIGS. 8A to 8C show a state in which a plurality of inner-conductor-formed holes are simultaneously subjected to cutting. In an example shown in FIG. 8A, four rotary cutting disks 5*a* to 5*d* have a thickness larger (by a predetermined minute width) than the cross-sectional width of inner-conductor-formed holes 2*a* to 2*d*, and are aligned with the inner-conductor-formed holes 2*a* to 2*d*. The rotary cutting disks 5*a* to 5*d* rotate about a rotating axis 8. In an example shown in FIG. 8B, the thicknesses of the four rotary cutting disks 5*a* to 5*d* vary and are larger (by a predetermined minute width) than the cross-sectional widths of the corresponding inner-conductor-formed holes 2*a* to 2*d*.

In an example shown in FIG. 8C, the diameters of the rotary cutting disks 5*a* to 5*d* differ depending on the cutting depths of the openings of the corresponding inner-conductor-formed holes 2*a* to 2*d*. The axial length of an inner conductor in each of the inner-conductor-formed holes 2*a* to 2*d* is thereby determined. Therefore, the cutting makes it possible to form the open portion of the inner conductor, and to determine the resonant frequency of the resonator formed by the inner conductor on the inner surface of the inner-conductor-formed hole.

Figure 7:
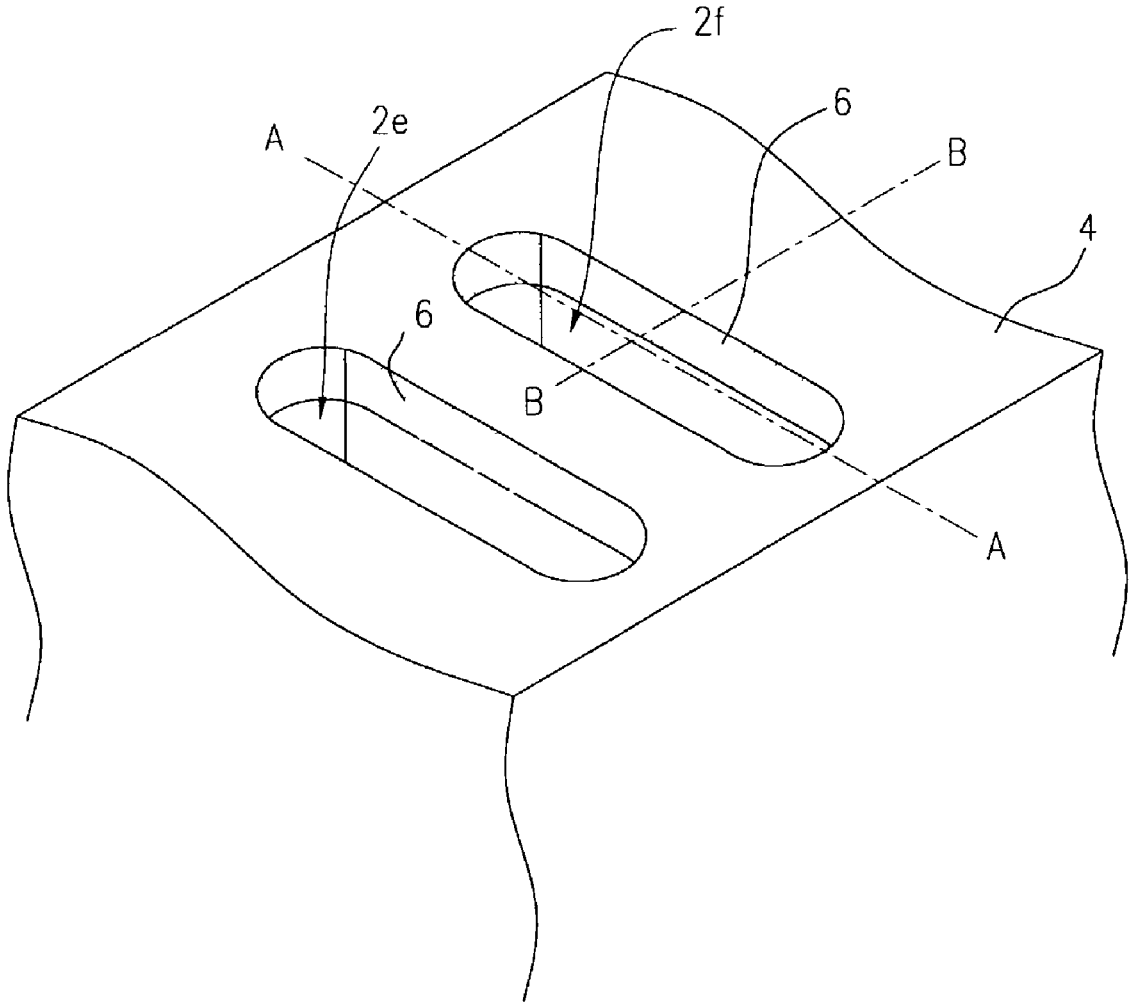
FIG. 7 is a partial perspective view of a dielectric duplexer according to a second aspect of the present invention.

FIG. 7 is a partial perspective view of the dielectric duplexer after the above cutting process. In this way, a cut portion 6 is formed by cutting the edge of the opening of each inner-conductor-formed hole so as to separate the inner conductor and the outer conductor.

The three inner-conductor-formed holes 2*a*, 2*g*, and 2*l* of circular cross-section shown in FIG. 9 are used as exciting holes. Without cutting the openings shown in FIG. 9, the inner-conductor-formed holes 2*a*, 2*g*, and 2*l* are opened at the opposite face on the right rear side of the figure, and input and output terminals are formed in the open portions so that they serve as a transmission-signal input terminal, an antenna terminal, and a reception-signal output terminal.

While the inner-conductor-formed holes have an elliptical cross section in the above embodiments, the present invention is also applicable to a case in which the inner-conductor-formed holes have a substantially rectangular cross section.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of producing a dielectric resonator, the method comprising:

moving a rotary cutting disk in a depth direction of at least one hole in a dielectric block, the rotary cutting disk having an axis of rotation substantially perpendicular to the depth direction of the at least one hole;

abutting an edge of an opening of the at least one hole with the rotary cutting disk; and cutting an inner conductor within the at least one hole together with an outer conductor on an outer surface of the dielectric block such that the inner conductor and the outer conductor are separated from each other only at the edge of the opening of the at least one hole so that the at least one hole is formed into a resonator having a stray capacitor at the opening of the at least one hole, wherein the dielectric block includes a plurality of holes, each of the plurality of holes having a depth direction, and the cutting of the inner conductor and the outer conductor of each of the plurality of holes is carried out by a respective plurality of cutting disks, each cutting disk of the plurality of cutting disks rotating about an axis perpendicular to the depth direction of the hole corresponding to that cutting disk.

2. The method of producing a dielectric resonator according to claim 1, wherein a portion of the dielectric block is cut together with the inner conductor and the outer conductor.

3. The method of producing a dielectric resonator according to claim 1, wherein the at least one hole in the dielectric block is formed into a quarter-wavelength resonator having a stray capacitor at the opening of the at least one hole.

4. The method of producing a dielectric resonator according to claim 1, wherein the cutting disk is moved a fixed distance in the depth direction so as to control the amount of separation between the inner conductor and the outer conductor.

5. The method of producing a dielectric resonator according to claim 1, wherein the plurality of holes are aligned with one another and the cutting is performed simultaneously for each of the plurality of holes.

6. The method of producing a dielectric resonator according to claim 1, wherein at least two of the cutting disks have different diameters.

7. A method of producing a dielectric resonator, the method comprising:

moving a rotary cutting disk in a depth direction of at least one hole in a dielectric block, the rotary cutting disk having an axis of rotation substantially perpendicular to the depth direction of the at least one hole;

abutting an edge of an opening of the at least one hole with the rotary cutting disk; and cutting an inner conductor within the at least one hole together with an outer conductor on an outer surface of the dielectric block such that the inner conductor and the outer conductor are separated from each other at the opening of the at least one hole, wherein the dielectric block includes a plurality of holes, each of the plurality of holes having a depth direction, and the cutting of the inner conductor and the outer conductor of each of the plurality of holes is carried out by a respective plurality of cutting disks, each cutting disk of the plurality of cutting disks rotating about an axis perpendicular to the depth direction of the hole corresponding to that cutting disk, and wherein at least two of the respective cutting disks have a different thickness.

* * * * *